US011428226B2

(12) United States Patent
Ohnishi et al.

(10) Patent No.: US 11,428,226 B2
(45) Date of Patent: Aug. 30, 2022

(54) MULTISTAGE COMPRESSION SYSTEM

(71) Applicant: DAIKIN INDUSTRIES, LTD., Osaka (JP)

(72) Inventors: Yousuke Ohnishi, Osaka (JP); Masaaki Adachi, Osaka (JP); Mikio Kajiwara, Osaka (JP); Naoto Tomioka, Osaka (JP); Yohei Nishide, Osaka (JP); Daisuke Okamoto, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/280,097

(22) PCT Filed: Sep. 25, 2019

(86) PCT No.: PCT/JP2019/037672
§ 371 (c)(1),
(2) Date: Mar. 25, 2021

(87) PCT Pub. No.: WO2020/067197
PCT Pub. Date: Apr. 2, 2020

(65) Prior Publication Data

US 2021/0310703 A1 Oct. 7, 2021

(30) Foreign Application Priority Data

Sep. 28, 2018 (JP) ..... JP2018-185073
Dec. 13, 2018 (JP) ..... JP2018-233789

(51) Int. Cl.
*F04C 23/00* (2006.01)
*F04C 29/02* (2006.01)
*F25B 1/10* (2006.01)

(52) U.S. Cl.
CPC ..... *F04C 23/00* (2013.01); *F04C 29/02* (2013.01); *F25B 1/10* (2013.01); *F04C 2240/40* (2013.01); *F04C 2240/804* (2013.01)

(58) Field of Classification Search
CPC ..... F04C 29/02; F04C 2240/40; F04C 2240/804; F04C 28/02; F04C 23/00–006; F25B 1/10; F25B 31/004; F25B 31/026
See application file for complete search history.

(56) References Cited

U.S. PATENT DOCUMENTS 5,236,311 A * 8/1993 Lindstrom ..... F04B 25/00 417/254
2007/0245768 A1 10/2007 Sakae et al.
(Continued)

FOREIGN PATENT DOCUMENTS

DE 10 2013 014 543 A1 3/2015
EP 2 172 653 A1 4/2010
(Continued)

OTHER PUBLICATIONS

Emerson Climate Technologies, Suction Line Accumulators, Mar. (Year: 2014).*
(Continued)

*Primary Examiner* — Alexander B Comley
(74) *Attorney, Agent, or Firm* — Global IP Counselors, LLP

(57) ABSTRACT

A multistage compression system uses refrigerant and oil. The multistage compression system includes a low-stage compressor that compresses the refrigerant, a high-stage compressor that further compresses the refrigerant compressed by the low-stage compressor, refrigerant pipes that introduce the refrigerant compressed and discharged by the low-stage compressor into a suction part of the high-stage compressor, a pressure reducing element disposed between the refrigerant pipes, an accumulator disposed between the refrigerant pipes at a downstream side of the pressure reducing element and at an upstream side of the high-stage compressor, and an oil discharge pipe. The oil discharge pipe discharges the oil in the low-stage compressor. The oil
(Continued)

discharge pipe connects the low-stage compressor and a portion of the refrigerant pipes. The portion of the refrigerant pipes is on a downstream side of the pressure reducing element and an upstream side of the accumulator.

13 Claims, 6 Drawing Sheets

(56) References Cited

U.S. PATENT DOCUMENTS

| | | | |
|---|---|---|---|
| 2008/0152524 | A1 | 6/2008 | Kishi et al. |
| 2011/0036110 | A1 | 2/2011 | Fujimoto et al. |

FOREIGN PATENT DOCUMENTS

| | | | | |
|---|---|---|---|---|
| EP | 2 863 151 | A2 | | 4/2015 |
| EP | 3 136 020 | A1 | | 3/2017 |
| JP | 4-371759 | A | | 12/1992 |
| JP | 04371759 | A | * | 12/1992 |
| JP | 7-260263 | A | | 10/1995 |
| JP | 7-301465 | A | | 11/1995 |
| JP | 2001-272122 | A | | 10/2001 |
| JP | 2004-285854 | A | | 10/2004 |
| JP | 2006-258002 | A | | 9/2006 |
| JP | 2006-348951 | A | | 12/2006 |
| JP | 2007-9922 | A | | 1/2007 |
| JP | 2007-93017 | A | | 4/2007 |
| JP | 2008-175066 | A | | 7/2008 |
| JP | 2008-261227 | A | | 10/2008 |
| JP | 2008261227 | A | * | 10/2008 |
| JP | 2009-79820 | A | | 4/2009 |
| JP | 2009-133584 | A | | 6/2009 |
| JP | 2011-202817 | A | | 10/2011 |
| JP | 2011-214758 | A | | 10/2011 |
| JP | 2012-180963 | A | | 9/2012 |
| JP | 2013-181736 | A | | 9/2013 |
| JP | 2015-34536 | A | | 2/2015 |
| JP | 2015-78804 | A | | 4/2015 |
| JP | 2017-44420 | A | | 3/2017 |
| JP | 2018-31263 | A | | 3/2018 |

OTHER PUBLICATIONS

International Search Report of corresponding PCT Application No. PCT/JP2019/037672 dated Dec. 10, 2019.

International Preliminary Report of corresponding PCT Application No. PCT/JP2019/037672 dated Apr. 8, 2021.

European Search Report of corresponding EP Application No. 19 86 6259.5 dated Sep. 14, 2021.

European Search Report of corresponding EP Application No. 19 86 6258.7 dated Oct. 21, 2021.

European Search Report of corresponding EP Application No. 19 86 7267 dated Oct. 5, 2021.

European Search Report of corresponding EP Application No. 19 86 4032.8 dated Sep. 29, 2021.

* cited by examiner

MULTISTAGE COMPRESSION SYSTEM

CROSS-REFERENCE TO RELATED APPLICATIONS

This U.S. National stage application claims priority under 35 U.S.C. § 119(a) to Japanese Patent Application Nos. 2018-185073, filed in Japan on Sep. 28, 2018 and 2018-233789, filed in Japan on Dec. 13, 2018, the entire contents of which are hereby incorporated herein by reference.

BACKGROUND

Field of the Invention

A multistage compression system using refrigerant and oil.

Background Information

In a refrigeration apparatus, a multistage compression mechanism using a plurality of compressors is recommended and used depending on working refrigerant. In the multistage compression mechanism using the plurality of compressors, it is important to control refrigerator oil in an appropriate amount in the plurality of compressors. In other words, the oil is to be controlled not to be extremely unevenly distributed in one compressor.

In (JP 2008-261227 A, a low-stage oil drain passage in a low-stage compressor and an oil return passage for returning oil discharged in a high-stage compressor to a suction pipe of the low-stage compressor are provided in order to keep an oil level of the low-stage and high-stage compressors constant.

SUMMARY

In JP 2008-261227 A, the low-stage oil drain passage is connected to a suction side of the high-stage compressor downstream of a high-stage accumulator. Further, an intercooler or a refrigerant merging point of an intermediate injection is not considered. However, if a pressure reducing element such as the intercooler or the refrigerant merging point of the intermediate injection is provided in a refrigerant pipe from a low-stage refrigerant discharge part to a high-stage refrigerant suction part, a pressure of the refrigerant pipe reduces. Thus, depending on a connection position of the oil drain passage, an amount of refrigerant and oil passing through the oil drain passage varies, and the amount of oil in the low-stage compressor also varies. Consequently, when the pressure reducing element is provided, it is necessary to appropriately select the connection position of the oil drain passage to the refrigerant pipe in accordance with the amount of oil in the low-stage compressor.

A multistage compression system according to a first aspect uses refrigerant and oil. The multistage compression system has a low-stage compressor, a high-stage compressor, refrigerant pipes, a pressure reducing element, and an oil discharge pipe. The low-stage compressor compresses the refrigerant. The high-stage compressor further compresses the refrigerant compressed by the low-stage compressor. The refrigerant pipe introduces the refrigerant compressed and discharged by the low-stage compressor into a suction part of the high-stage compressor. The pressure reducing element is disposed between the refrigerant pipes. The oil discharge pipe discharges the oil in the low-stage compressor. The oil discharge pipe connects the low-stage compressor and a portion of the refrigerant pipes, which is a downstream side of the pressure reducing element.

In the multistage compression system according to the first aspect, the oil discharge pipe connects the low-stage compressor and a portion of the refrigerant pipes, which is a downstream side of the pressure reducing element. Thus, an amount of oil discharged from the oil discharge pipe increases, and an amount of oil in the low-stage compressor can be controlled not to be excessively large.

A multistage compression system according to a second aspect is the system according to the first aspect, in which the low-stage compressor comprises a compression part, a motor, and a container. The compression part is a rotary type. The compression part is provided with a compression chamber. The refrigerant is compressed in the compression chamber. The motor drives the compression part. The motor is disposed above the compression part. The container houses the compression part and the motor. The oil discharge pipe is connected to the container below the motor and above the compression chamber. When the low-stage compressor has two or more compression chambers having different heights, the compression chamber referred to here means a lowest compression chamber.

In the multistage compression system according to the second aspect, because the oil discharge pipe is connected to a position above the compression chamber of the container and below the motor, excess oil of the low-stage compressor can be discharged from the low-stage compressor without excess or deficiency.

A multistage compression system according to a third aspect is the system according to the first or second aspect, in which the pressure reducing element is an intercooler. The intercooler cools the refrigerant discharged by the low-stage compressor before the refrigerant is sucked into the high-stage compressor.

In the multistage compression system according to the third aspect, the oil discharge pipe is connected to the low-stage compressor and the refrigerant pipe downstream of the intercooler. Thus, the amount of oil discharged from the oil discharge pipe increases, and the amount of oil in the low-stage compressor can be controlled appropriately.

A multistage compression system according to a fourth aspect is the system according to the first or second aspect, in which the pressure reducing element is a merging part merging an intermediate injection passage. The merging part merging the intermediate injection passage cools the refrigerant discharged by the low-stage compressor before the refrigerant is sucked into the high-stage compressor.

In the multistage compression system according to the fourth aspect, the oil discharge pipe is connected to the low-stage compressor and the refrigerant pipe downstream of the merging part merging the intermediate injection passage. Thus, the amount of oil discharged from the oil discharge pipe increases, and the amount of oil in the low-stage compressor can be controlled appropriately.

A multistage compression system according to a fifth aspect is the system according to the first or second aspect, in which the pressure reducing element is an intercooler and a merging part merging an intermediate injection passage. The intercooler cools the refrigerant discharged by the low-stage compressor before the refrigerant is sucked into the high-stage compressor. The merging part of the intermediate injection passage cools the refrigerant discharged by the low-stage compressor before the refrigerant is sucked into the high-stage compressor.

In the multistage compression system according to the fifth aspect, one end of the oil discharge pipe is connected to the low-stage compressor and the other end of the discharge pipe is connected to a portion of the refrigerant pipes, which is a downstream side of the intercooler and the merging part merging the intermediate injection passage. Thus, the amount of oil discharged from the oil discharge pipe further increases, and the amount of oil in the low-stage compressor can be controlled appropriately.

A multistage compression system according to a sixth aspect is the system according to any of the first to fifth aspects, in which the refrigerant is refrigerant mainly including carbon dioxide, and the oil is oil insoluble with carbon dioxide.

In the multistage compression system according to the sixth aspect, the refrigerant and the oil, which are insoluble with each other, are easily separated vertically in an oil reservoir of the low-stage compressor, and mainly excess refrigerant is easily discharged from the oil discharge pipe.

DETAILED DESCRIPTION OF EMBODIMENT(S)

First Embodiment (1) Refrigerant Circuit of Refrigeration Apparatus 1

(1-1) Entire Refrigerant Circuit of Refrigeration Apparatus 1

Figure 1:
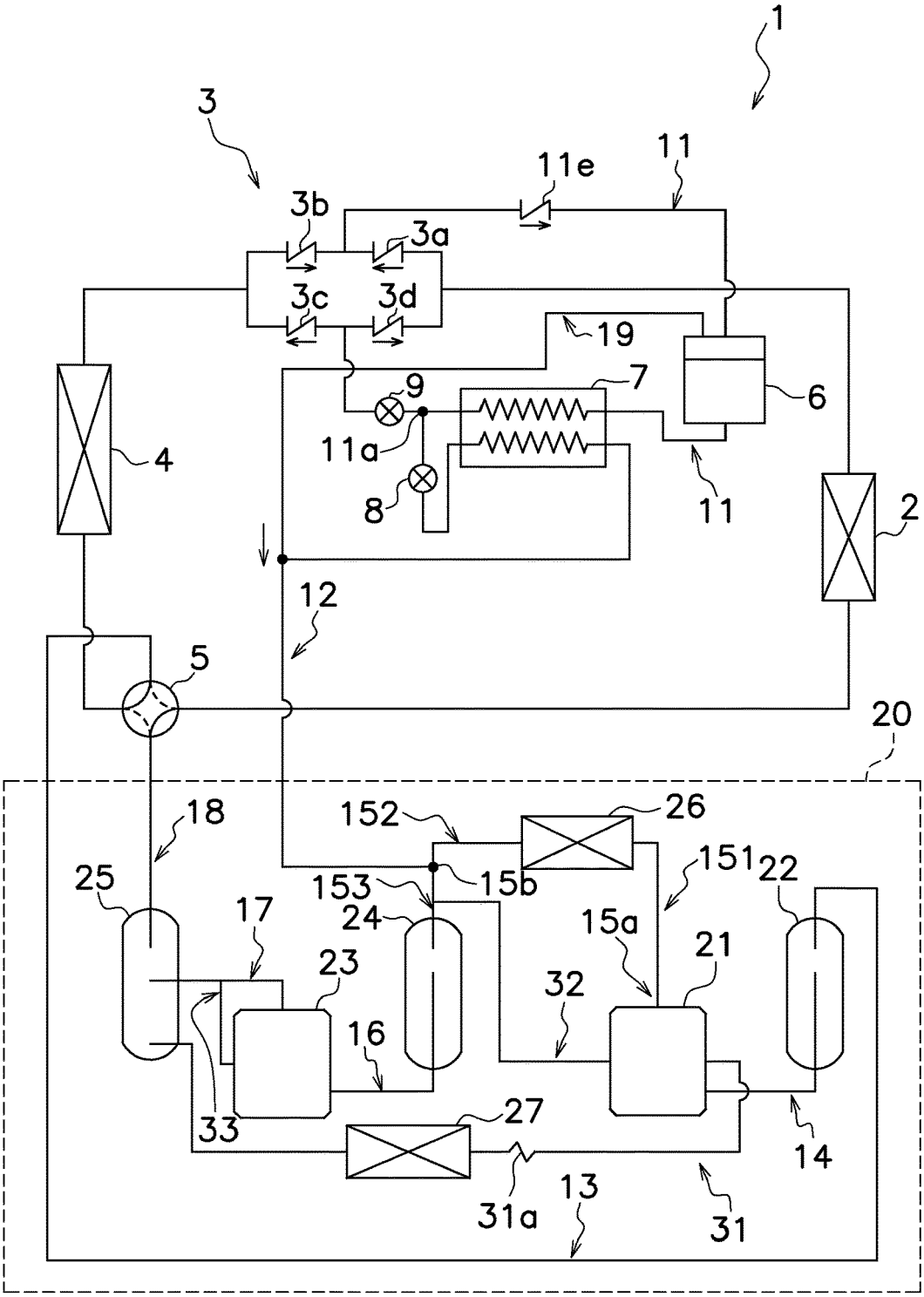
FIG. 1 is a refrigerant circuit diagram of a refrigeration apparatus 1 according to a first embodiment.

FIG. 1 shows a refrigerant circuit configuration of a refrigeration apparatus 1 according to a first embodiment. The refrigeration apparatus 1 according to the present embodiment is an apparatus that performs a two-stage compression refrigeration cycle using carbon dioxide as refrigerant that operates in a supercritical region. The refrigeration apparatus 1 according to the present embodiment can be used for an air conditioner for heating and cooling, an air conditioner dedicated for cooling, a water cooler and heater, a refrigerator, a refrigeration storage apparatus, and the like.

The refrigerant circuit of the refrigeration apparatus 1 according to the present embodiment has a multistage compression system 20, a four-way switching valve 5, a heat source side heat exchanger 2, a bridge circuit 3, expansion mechanisms 8 and 9, a use side heat exchanger 4, and an economizer heat exchanger 7.

The multistage compression system 20 compresses the refrigerant. Gas refrigerant is introduced into a first accumulator 22 at an inlet of a low-stage compressor 21 via the four-way switching valve 5 and a refrigerant pipe 13. The refrigerant is compressed by the low-stage compressor 21 and a high-stage compressor 23, and reaches the four-way switching valve 5 via a pipe 18.

The four-way switching valve 5 switches directions in which the refrigerant from the multistage compression system 20 flows to the heat source side heat exchanger 2 or to the use side heat exchanger 4. For example, when the refrigeration apparatus 1 is an air conditioner and is performing a cooling operation, the refrigerant flows from the four-way switching valve 5 to the heat source side heat exchanger 2 (condenser). The refrigerant flowing through the heat source side heat exchanger 2 (condenser) reaches a receiver 6 via a check valve 3*a* of the bridge circuit 3, a pipe 11, and a check valve 11*e*. The liquid refrigerant continues to flow from the receiver 6 through the pipe 11, is decompressed by the expansion mechanism 9, and flows to the use side heat exchanger 4 (evaporator) via a check valve 3*c* of the bridge circuit 3. The refrigerant heated by the use side heat exchanger 4 (evaporator) passes through the four-way switching valve 5, and is compressed again by the multistage compression system 20. On the other hand, during a heating operation, the refrigerant flows from the four-way switching valve 5 to the use side heat exchanger 4 (condenser), a check valve 3*b* of the bridge circuit 3, the pipe 11, the receiver 6, the expansion mechanism 9, a check valve 3*d* of the bridge circuit 3, the use side heat exchanger 4 (evaporator), and the four-way switching valve 5 in this order.

The economizer heat exchanger 7 is disposed between the receiver 6 and the expansion mechanism 9 in a middle of the refrigerant pipe 11. At a branch 11*a* of the pipe 11, a part of the refrigerant branches and is decompressed to an intermediate pressure at the expansion mechanism 8. The intermediate-pressure refrigerant is heated by the high-pressure refrigerant flowing through the pipe 11 in the economizer heat exchanger 7 and injected into a merging part 15*b* of an intermediate pressure of the multistage compression system 20 via an intermediate injection pipe 12. Further, a gas component of the refrigerant from the receiver 6 merges into the intermediate injection pipe 12 via the pipe 19.

(1-2) Flow of Refrigerant and Oil in Multistage Compression System 20

As shown in FIG. 1, the multistage compression system 20 according to the present embodiment includes the first accumulator 22, the low-stage compressor 21, an intercooler 26, a second accumulator 24, the high-stage compressor 23, an oil separator 25, an oil cooler 27, and a decompressor 31*a*.

In the present embodiment, the refrigerant compressed by the low-stage compressor 21 is further compressed by the high-stage compressor 23. The compressors 21 and 23 are provided with the accumulator 22 and the accumulator 24, respectively. The accumulators 22 and 24 play a role of storing the refrigerant before entering the compressor once and preventing the liquid refrigerant from being sucked into the compressor.

Next, a flow of the refrigerant and the oil in the multistage compression system 20 according to the present embodiment will be described with reference to FIG. 1.

In the present embodiment, the low-pressure gas refrigerant heated by the evaporator (use side heat exchanger 4 or heat source side heat exchanger 2) flows to the first accumulator 22 via the refrigerant pipe 13. The gas refrigerant of the first accumulator 22 flows to the low-stage compressor 21 via a suction pipe 14. The refrigerant compressed by the low-stage compressor 21 is discharged from a discharge pipe 15*a*, flows through intermediate pressure refrigerant pipes 151 to 153, and reaches the second accumulator 24.

The intercooler 26 is disposed between the intermediate pressure refrigerant pipes 151 and 152. The intercooler 26 is a heat exchanger that cools the intermediate-pressure refrigerant with, for example, outdoor air. The intercooler 26 may be disposed adjacent to the heat source side heat exchanger 2 and exchange heat with air by a common fan. The intercooler 26 enhances efficiency of the refrigeration apparatus 1 by cooling the intermediate-pressure refrigerant.

Further, the intermediate-pressure refrigerant is injected from the intermediate injection pipe 12 into the merging part 15*b* of the intermediate pressure refrigerant pipe. In the present embodiment, the merging part 15*b* of the intermediate injection pipe 12 with the pipe 152 is disposed downstream of the intercooler 26. A temperature of the refrigerant injected by intermediate injection is lower than a temperature of the refrigerant flowing through the pipe 152. Thus, the intermediate injection lowers the temperature of the refrigerant flowing through the pipe 152 and improves the efficiency of the refrigeration apparatus 1.

The multistage compression system 20 according to the present embodiment further includes an oil discharge pipe 32 that discharges excess oil from the low-stage compressor.

The oil discharge pipe 32 connects the low-stage compressor 21 and the pipe 153 of an intermediate pressure. The oil discharge pipe 32 discharges not only the excess oil accumulated in an oil reservoir of the low-stage compressor but also excess refrigerant accumulated in the oil reservoir. A connection part of the oil discharge pipe 32 with the intermediate pressure refrigerant pipe 153 is downstream of the merging part 15*b* of an intermediate injection passage and upstream of a suction part of the second accumulator 24.

The refrigerant sent to the second accumulator 24 by the pipe 153 is introduced into the high-stage compressor 23 from a suction pipe 16. The refrigerant is compressed in the high-stage compressor 23 to a high pressure, and is discharged to a discharge pipe 17.

The refrigerant discharged to the discharge pipe 17 flows to the oil separator 25. The oil separator 25 separates the refrigerant from the oil. The separated oil is returned to the low-stage compressor 21 via an oil return pipe 31.

The multistage compression system 20 according to the present embodiment further includes an oil discharge pipe 33 that discharges excess oil from the high-stage compressor. The oil discharge pipe 33 connects the high-stage compressor 23 and the discharge pipe 17 of the high-stage compressor 23.

The decompressor 31*a* is disposed in a middle of the oil return pipe 31. The decompressor 31*a* is for decompressing the high-pressure oil discharged from the oil separator 25. Specifically, for example, a capillary tube is used for the decompressor 31*a*.

The oil cooler 27 is disposed in the middle of the oil return pipe 31. The oil cooler 27 is a heat exchanger that cools the oil flowing through the oil return pipe 31, for example, with the outdoor air. The oil cooler 27 is for cooling the high-temperature oil discharged from the oil separator 25. The oil cooler 27 may be disposed, for example, near the heat source side heat exchanger 2 and may exchange heat with air by a common fan.

The oil (refrigerator oil) according to the present embodiment is not limited as long as the oil is refrigerator oil used as $CO_2$ refrigerant, but oil insoluble with the $CO_2$ refrigerant is particularly suitable. Examples of refrigerator oil include polyalkylene glycols (PAG) and polyolester (POE).

The refrigeration apparatus 1 according to the present embodiment performs two-stage compression with two compressors. Two or more stages of compression may be performed using three or more compressors. Further, three or more stages of compression may be performed.

In the present embodiment, the oil return pipe 31 returns the oil from the oil separator 25 to the low-stage compressor 21. The oil return pipe 31 may directly return the oil discharged from the high-stage compressor 23 to the low-stage compressor 21.

(2) Structure of Compressors, Pipes Connected to the Compressors and Devices

Both the low-stage compressor 21 and the high-stage compressor 23 according to the present embodiment are two-cylinder and oscillating rotary compressors. The compressors 21 and 23, which have almost the same configuration, will be described in detail here using the low-stage compressor 21.

Figure 2:
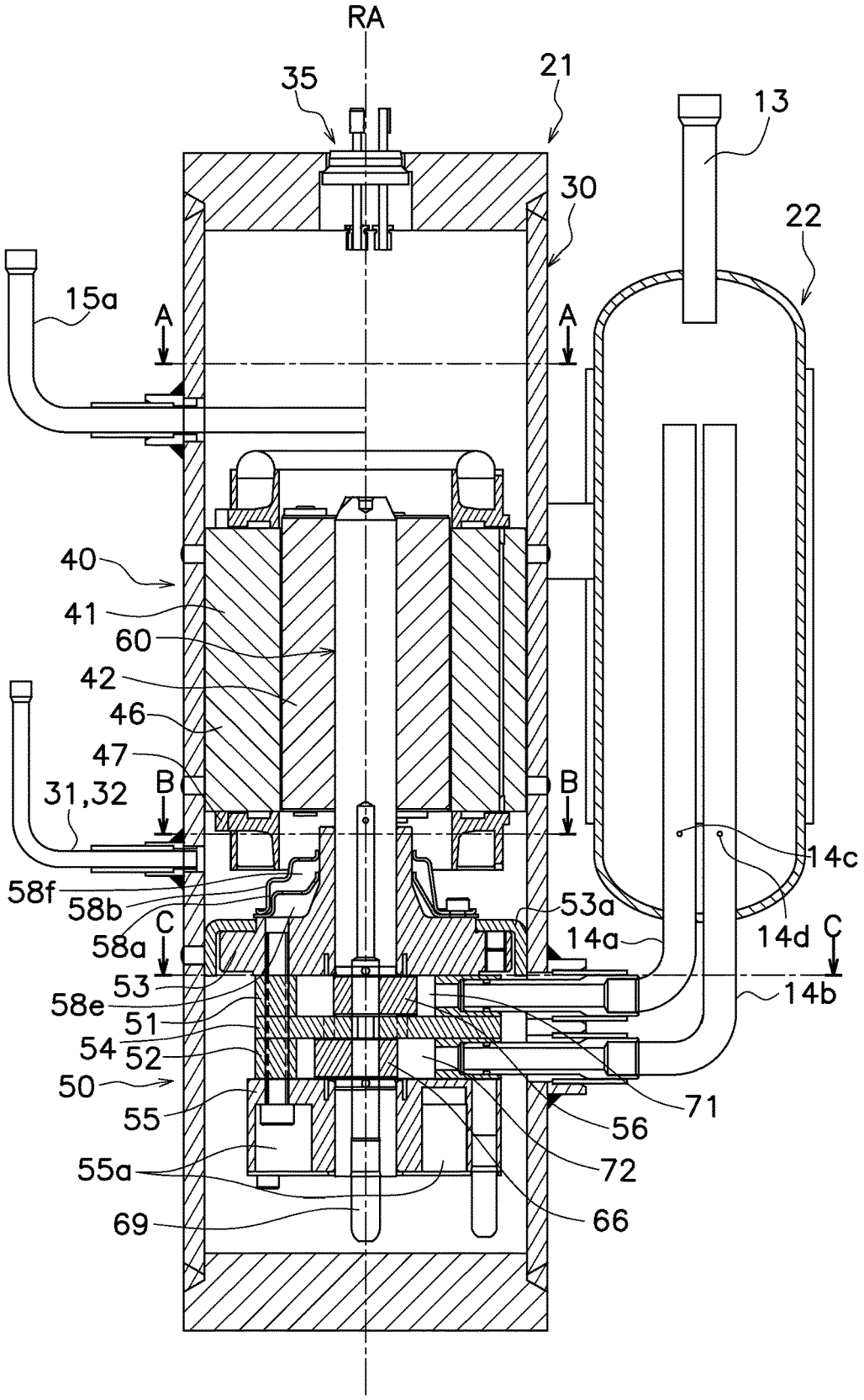
FIG. 2 is a vertical sectional view of a low-stage compressor 21 according to the first embodiment.
Figure 3:
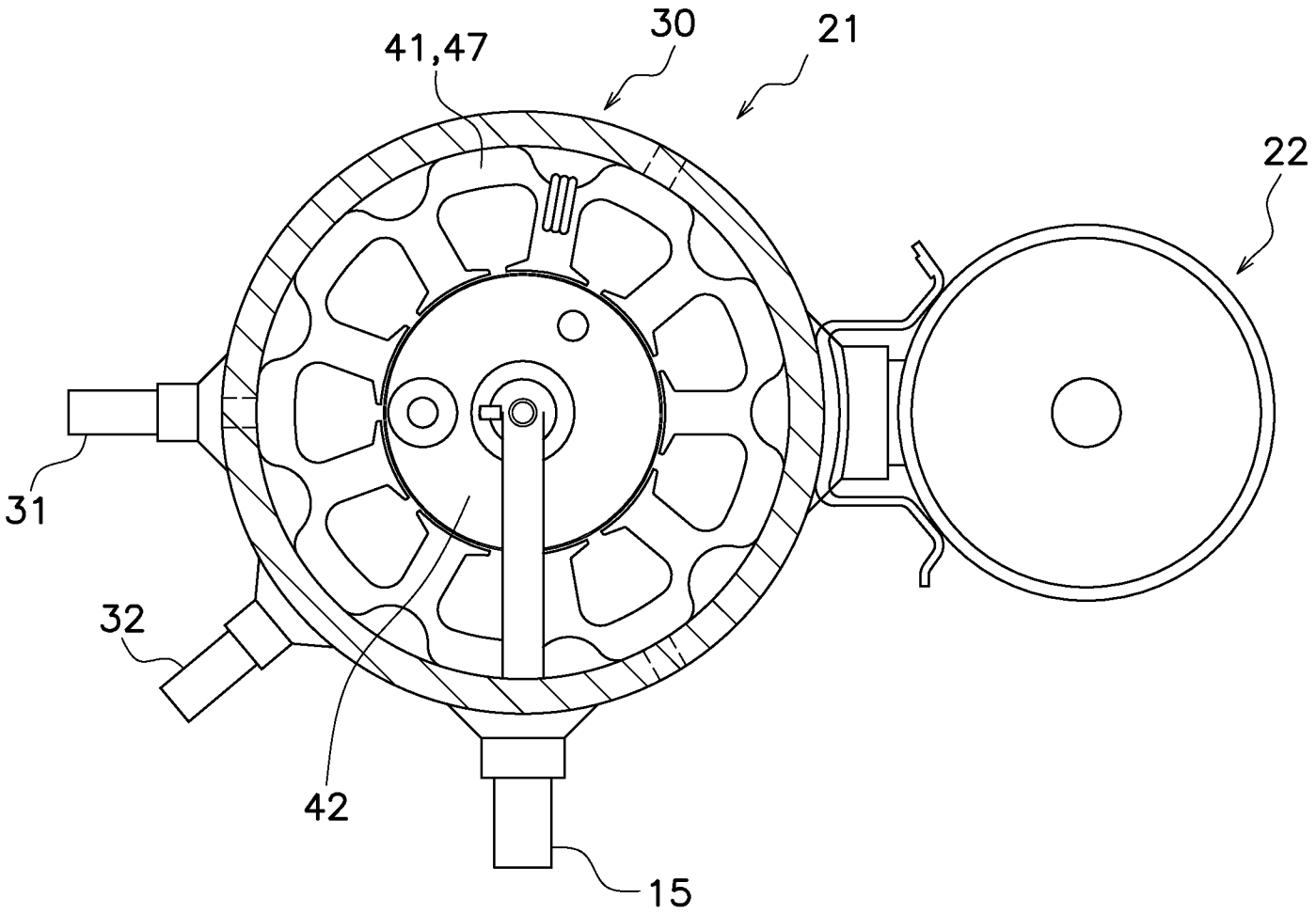
FIG. 3 is a sectional view taken along line A-A of the low-stage compressor 21 according to the first embodiment.
Figure 4:
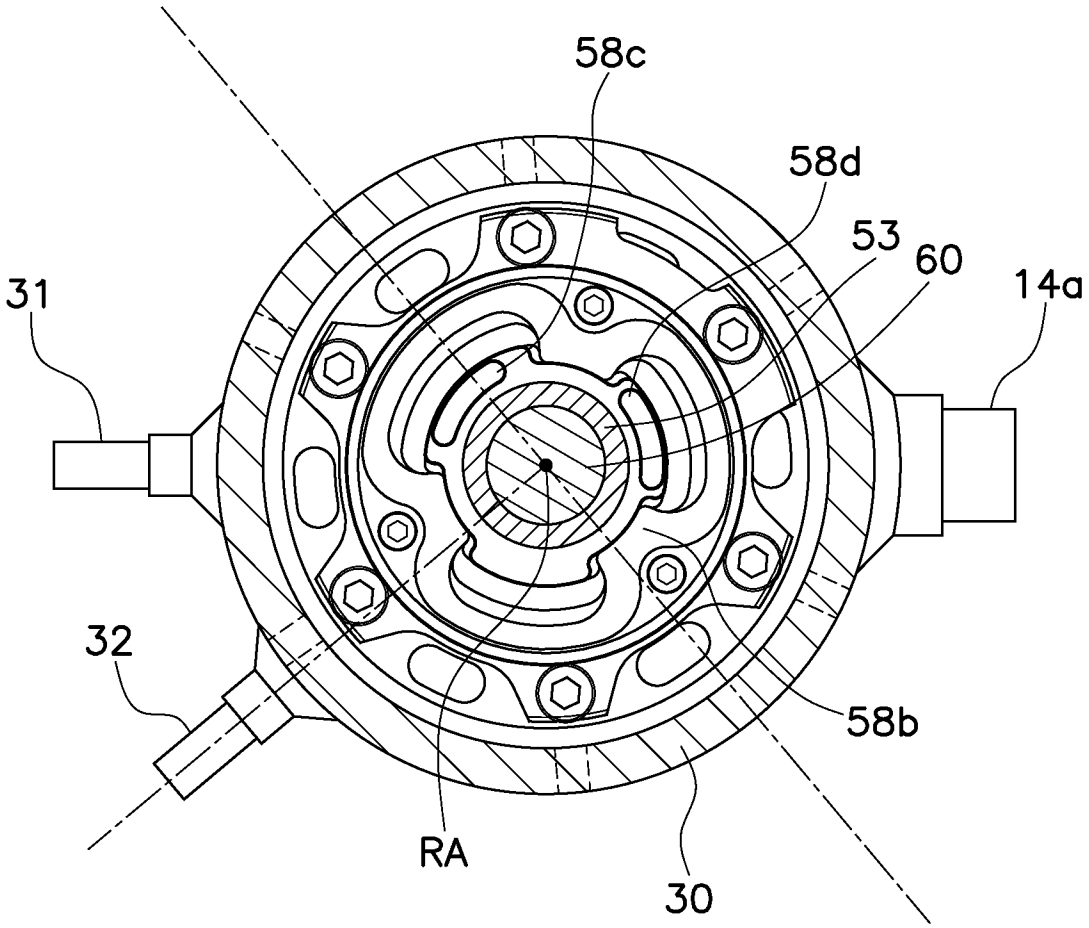
FIG. 4 is a sectional view taken along line B-B of the low-stage compressor 21 according to the first embodiment.
Figure 5:
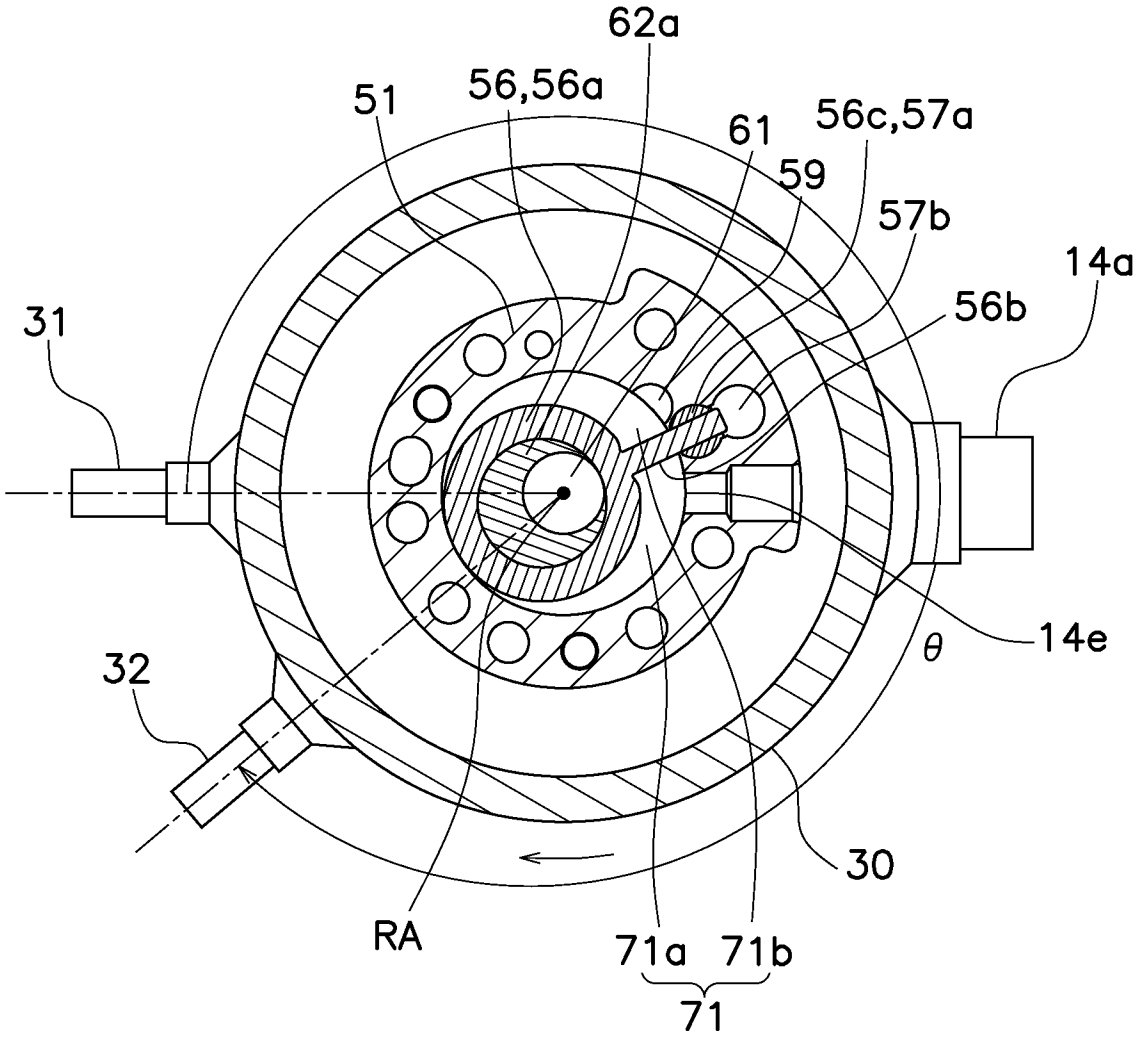
FIG. 5 is a sectional view taken along line C-C of the low-stage compressor 21 according to the first embodiment.

FIG. 2 is a vertical sectional view of the low-stage compressor 21, and FIGS. 3 to 5 are horizontal sectional views taken along lines A-A to C-C in FIG. 2, respectively. However, in the B-B sectional view in FIG. 4, components of a motor 40 are not shown.

The low-stage compressor 21 has a container 30, a compression part 50, the motor 40, a crankshaft 60, and a terminal 35.

(2-1) Container 30

The container 30 has a substantially cylindrical shape with an axis RA of the motor 40 as a center axis. The inside of the container is kept airtight, and an intermediate pressure is maintained in the low-stage compressor 21 and a high pressure is maintained in the high-stage compressor 23 during an operation. A lower part of the inside of the container 30 is the oil reservoir (not shown) for storing oil (lubricating oil).

The container 30 houses the motor 40, the crankshaft 60, and the compression part 50 inside. The terminal 35 is located above the container 30. Further, the container 30 is connected to suction pipes 14*a* and 14*b* and the discharge pipe 15*a* of the refrigerant, the oil return pipe 31, and the oil discharge pipe 32.

(2-2) Motor 40

The motor 40 is a brushless DC motor. The motor 40 generates power to rotate the crankshaft 60 around the axis RA. The motor 40 is disposed in a space inside the container 30, below an upper space, and above the compression part 50. The motor 40 has a stator 41 and a rotor 42. The stator 41 is fixed to an inner wall of the container 30. The rotor 42 rotates by magnetically interacting with the stator 41.

The stator 41 has a stator core 46 and insulators 47. The stator core 46 is made of steel. The insulator 47 is made of resin. The insulators 47 are disposed above and below the stator core 46, and wires are wound around the insulators 47.

(2-3) Crankshaft 60

The crankshaft 60 transmits power of the motor 40 to the compression part 50. The crankshaft 60 has a main shaft 61, a first eccentric part 62*a*, and a second eccentric part 62*b*.

The main shaft 61 is a part concentric with the axis RA. The main shaft 61 is fixed to the rotor 42.

The first eccentric part 62*a* and the second eccentric part 62*b* are eccentric with respect to the axis RA. A shape of the first eccentric part 62*a* and a shape of the second eccentric part 62*b* are symmetrical with respect to the axis RA.

An oil tube 69 is provided at a lower end of the crankshaft 60. The oil tube 69 pumps oil (lubricating oil) from the oil reservoir. The pumped lubricating oil rises in an oil passage inside the crankshaft 60 and is supplied to a sliding part of the compression part 50.

(2-4) Compression Part 50

The compression part 50 is a two-cylinder compression mechanism. The compression part 50 has a first cylinder 51, a first piston 56, a second cylinder 52, a second piston 66, a front head 53, a middle plate 54, a rear head 55, and front mufflers 58*a* and 58*b*.

A first compression chamber 71 and a second compression chamber 72 are formed in the compression part 50. The first and second compression chambers are spaces to which the refrigerant is supplied and compressed.

In the multistage compression system 20 according to the first embodiment, the compressors 21 and 23 are both two-cylinder compressors. Both or one of the compressors may be a one-cylinder compressor.

(2-4-1) First Compression Chamber 71 and Flow of Refrigerant Compressed in First Compression Chamber 71

As shown in FIG. 2 or 5, the first compression chamber 71 is a space surrounded by the first cylinder 51, the first piston 56, the front head 53, and the middle plate 54.

As shown in FIG. 5, the first cylinder 51 is provided with a suction hole 14*e*, a discharge concave portion 59, a bush housing hole 57*a*, and a blade moving hole 57*b*. The first cylinder 51 houses the main shaft 61 and the first eccentric part 62*a* of the crankshaft 60 and the first piston 56. The suction hole 14*e* communicates the first compression chamber 71 with the inside of the suction pipe 14*a*. A pair of bushes 56*c* is housed in the bush housing hole 57*a*.

The first piston 56 has an annular part 56*a* and a blade 56*b*. The first eccentric part 62*a* of the crankshaft 60 is fitted into the annular part 56*a*. The blade 56*b* is sandwiched between the pair of bushes 56*c*. The first piston 56 divides the first compression chamber 71 into two. One of the divided chambers is a low pressure chamber 71*a* that communicates with the suction hole 14*e*. The other divided chamber is a high pressure chamber 71*b* that communicates with the discharge concave portion 59. In FIG. 5, the annular part 56*a* revolves clockwise, a volume of the high pressure chamber 71*b* becomes small, and the refrigerant in the high pressure chamber 71*b* is compressed. When the annular part 56*a* revolves, a tip of the blade 56*b* reciprocates between the blade moving hole 57*b* and the bush housing hole 57*a*.

As shown in FIG. 2, the front head 53 is fixed to an inner side of the container 30 by an annular member 53*a*.

The front mufflers 58*a* and 58*b* are fixed to the front head 53. The front mufflers reduce noise when the refrigerant is discharged.

The refrigerant compressed in the first compression chamber 71 is discharged to a first front muffler space 58*e* between the front muffler 58*a* and the front head 53 via the discharge concave portion 59. After further moving to a second front muffler space 58*f* between the two front mufflers 58*a* and 58*b*, the refrigerant is blown out to a space below the motor 40 from discharge holes 58*c* and 58*d* (see FIG. 4) provided in the front muffler 58*b*.

The refrigerant that has been compressed and blown out from the discharge holes 58*c* and 58*d* of the front muffler 58*a* moves to an upper space of the container 30 through a gap of the motor 40, is blown out from the discharge pipe 15*a*, and proceeds to the high-stage compressor 23.

(2-4-2) Second Compression Chamber 72 and Flow of Refrigerant Compressed in Second Compression Chamber 72

The second compression chamber 72 is a space surrounded by the second cylinder 52, the second piston 66, the rear head 55, and the middle plate 54.

The flow of the refrigerant compressed in the second compression chamber 72, which is almost similar to the flow of the refrigerant compressed in the first compression chamber 71, will not be described in detail. However, the refrigerant compressed in the second compression chamber 72 is different in that the refrigerant is once sent to a rear muffler space 55*a* provided in the rear head 55, and then further sent to the front muffler spaces 58*e* and 58*f* by the front mufflers 58*a* and 58*b*.

In the multistage compression system 20 according to the first embodiment, the rotary compression part of the compressor 21 has the first piston 56 in which the annular part 56*a* and the blade 56*b* are integrated. The rotary compression part may have a vane instead of a blade, and the vane and the piston may be separate bodies.

(2-5) Connection Position of Compressor with Oil Return Pipe 31 and Oil Discharge Pipe 32

As shown in FIG. 2, the oil return pipe 31 is connected to the container 30 such that an internal flow path communicates with the space above the compression part 50 below the motor 40. The oil blown out of the oil return pipe 31 into the container 30 collides with the insulator 47 of the motor 40 and then falls on the front muffler 58*b* and the annular member 53*a* fixing the front head 53, and further, merges into the oil reservoir at the lower part of the inside of the container 30.

The oil return pipe 31 is preferably connected to a space above the second compression chamber 72. If the oil return pipe 31 is connected to a space below the second compression chamber 72, there is a high possibility that the connecting portion of the oil return pipe 31 might be below an oil level of the oil reservoir, thereby causing foaming which is not preferable.

Further, the oil return pipe 31 may be connected to an upper portion of the container 30. For example, the oil return pipe 31 may be connected to a core cut part of the stator 41 of the motor 40. However, the oil return pipe 31 is preferably connected to a lower part as close as possible to the oil reservoir, allowing the oil to be supplied to a sliding part (near the compression chambers 71 and 72) more quickly.

An inner diameter of the oil return pipe 31 is, for example, 10 mm or more and 12 mm or less.

As shown in FIG. 2, the oil discharge pipe 32 is connected to the container 30 such that the internal flow path communicates with the space above the compression part 50 below the motor 40.

If the connection position of the oil discharge pipe 32 to the container 30 is below the compression chamber 72, the oil may be lost excessively from the oil reservoir. If the connection position is above the motor 40, a difference between the oil discharge pipe 32 and the discharge pipe 15*a* will be small, and separately providing the oil discharge pipe 32 will be meaningless.

Further, in the present embodiment, as shown in FIG. 2, an attachment height position of the oil discharge pipe 32 with the container 30 is equivalent to an attachment height position of the oil return pipe 31 with the container 30. This facilitates adjustment of the oil level of the oil reservoir.

Further, as shown in FIG. 4, in a plain view, the connecting portion of the oil discharge pipe 32 to the container 30 is a position opposite to the discharge holes 58*c* and 58*d* of the front muffler 58*b* with respect to the axis RA of the motor 40. Here, the opposite position refers to a range of 180° other than a total of 180°, which is 90° to left and right of the axis RA from the connection position of the oil discharge pipe 32. Here, this means that half or more of an area of the discharge holes 58*c* and 58*d* is on the opposite side although a part of the discharge hole 58*c* is not in the opposite position in FIG. 4.

In the present embodiment, the connection position of the oil discharge pipe 32 to the container 30 is separated from positions of the discharge holes 58*c* and 58*d* of the front muffler 58*b*. This can reduce the refrigerant discharged from the discharge holes 58*c* and 58*d* of the front muffler 58*b* to be discharged from the low-stage compressor 21 directly by the oil discharge pipe 32.

An inner diameter of the oil discharge pipe 32 is equivalent to the inner diameter of the oil return pipe 31. The oil discharge pipe 32 having a smaller inner diameter than the discharge pipe 15*a* is used. Specifically, the inner diameter of the oil discharge pipe 32 is, for example, 10 mm or more and 12 mm or less.

Further, as shown in FIG. 5, in a planar positional relationship between the oil discharge pipe 32 and the oil return pipe 31, the connection position of the oil discharge pipe 32 to the container 30 is separated from the connection position of the oil return pipe 31 to the container 30 by 90° or more in a rotation direction of the motor 40 (a direction of an arrow in FIG. 5). The connection position is preferably a position separated by 180° or more. In the present embodiment, this angle is represented by θ. Theta is 270° or more. Also, θ is to be 330° or less.

In the present embodiment, the positions of the oil discharge pipe 32 and the oil return pipe 31 are sufficiently separated, and this reduces the oil introduced into the container 30 of the low-stage compressor 21 by the oil return pipe 31 to be discharged outside the container 30 directly by the oil discharge pipe 32, thereby easily equalizing the oil in the low-stage compressor 21.

In the multistage compression system 20 according to the first embodiment, the connection position of the oil return pipe 31 to the container 30 is as high as the connection position of the oil discharge pipe 32 to the container 30. The connection position of the oil return pipe 31 to the container 30 may be higher than the connection position of the oil discharge pipe 32 to the container 30.

(2-6) Accumulator 22

In the multistage compression system 20 according to the present embodiment, the first accumulator 22 is disposed upstream of the low-stage compressor 21 and the second accumulator 24 is disposed upstream of the high-stage compressor 23. The accumulators 22 and 24 once store the flowing refrigerant, prevent the liquid refrigerant from flowing to the compressor, and prevent liquid compression of the compressor. Configurations of the first accumulator 22 and the second accumulator 24 are almost the same, and thus the first accumulator 22 will be described with reference to FIG. 2.

The low-pressure gas refrigerant heated by the evaporator flows through the refrigerant pipe 13 via the four-way switching valve 5 and is introduced into the accumulator 22. The gas refrigerant is introduced into the first and second compression chambers 71 and 72 from the suction pipes 14*a* and 14*b* of the compressor 21. The liquid refrigerant and the oil accumulate at a lower part inside the accumulator. Small holes 14*c* and 14*d* are formed in the suction pipes 14*a* and 14*b* at a lower part inside the accumulator. Diameters of the holes 14*c* and 14*d* are, for example, from 1 mm to 2 mm. The oil, together with the liquid refrigerant, merges with the gas refrigerant little by little through the holes 14*c* and 14*d* and is sent to the compression chamber.

(3) Characteristics (3-1)

The multistage compression system 20 according to the present embodiment is a system having the low-stage compressor 21, the high-stage compressor 23, the intermediate pressure refrigerant pipes 151 to 153 and 16, a pressure reducing element, and the oil discharge pipe 32. The intermediate pressure refrigerant pipes 151 to 153 and 16 introduce the refrigerant compressed and discharged by the low-stage compressor 21 into a suction part of the high-stage compressor 23. The pressure reducing element is disposed between refrigerant pipes 151 to 153. The pressure reducing element reduces a pressure of the refrigerant flowing through the intermediate pressure refrigerant pipes. The oil discharge pipe 32 discharges the excess oil or liquid refrigerant from the low-stage compressor 21. The oil discharge pipe 32 connects the low-stage compressor 21 and the intermediate pressure refrigerant pipe 153 downstream of the pressure reducing element.

In the present embodiment, the pressure reducing element is both or either of the intercooler 26 and/or the merging part 15*b* of an intermediate injection passage. The intercooler 26 lowers the temperature and pressure of the refrigerant itself. At the merging part 15*b* of the intermediate injection passage, the refrigerant having a relatively low temperature and low pressure and flowing through the intermediate injection pipe 12 merges into the refrigerant flowing through the intermediate pressure refrigerant pipe 152, thereby decreasing the pressure of the refrigerant flowing through the intermediate pressure refrigerant pipe 152.

In the multistage compression system 20 according to the present embodiment, the oil discharge pipe 32 is connected to the middle of the intermediate pressure refrigerant pipe downstream of the pressure reducing element. A pressure in the intermediate pressure refrigerant pipe 153 is lowered by the pressure reducing element, and thus a pressure difference from inside the low-stage compressor increases, and a large amount of refrigerant or oil is quickly discharged from the oil discharge pipe 32. As a result, the amount of oil in the low-stage compressor can be appropriately controlled.

(3-2)

In the multistage compression system 20 according to the present embodiment, the oil discharge pipe 32 is connected to the container 30 above the compression chamber 72 and below the motor 40. In the present embodiment, the low-stage compressor 21 is a two-cylinder compressor, and there are two compression chambers, the first compression chamber 71 and the second compression chamber 72. In such a case, the term compression chamber refers to the second compression chamber 72.

In the multistage compression system 20 according to the present embodiment, because the oil discharge pipe 32 is connected to a position above the compression chamber 72 of the container 30 and below the motor 40, excess oil of the low-stage compressor 21 can be discharged from the low-stage compressor without excess or deficiency. Therefore, the amount of oil in the low-stage compressor can be controlled more quickly.

(3-3)

In the multistage compression system 20 according to the present embodiment, the refrigerant is a refrigerant mainly including carbon dioxide, and the oil is oil insoluble with carbon dioxide. Examples of oil insoluble with carbon dioxide are polyalkylene glycols (PAG) and polyolester (POE).

In such a mixed solution of insoluble oil and carbon dioxide refrigerant, when the refrigeration apparatus 1 is operated under normal temperature conditions (−20° C. or higher), the oil is in a lower part and the refrigerant is in an upper part due to a specific gravity.

This makes it easy to collect the liquid refrigerant above in the oil reservoir in the low-stage compressor 21 and discharge the excess liquid refrigerant from the oil discharge pipe 32.

(3-4)

The multistage compression system 20 according to the present embodiment further includes the oil return pipe 31. The oil return pipe 31 returns the oil discharged from the high-stage compressor 23 to the low-stage compressor 21.

The multistage compression system 20 according to the present embodiment has both the oil discharge pipe 32 and the oil return pipe 31, and thus the amount of oil in the low-stage compressor 21 can be smoothly controlled.

(4) Modifications (4-1) Modification 1A

The multistage compression system 20 according to the first embodiment includes the intercooler 26 upstream of the intermediate pressure refrigerant pipes 151 to 153 connected to the discharge pipe 15*a* of the low-stage compressor 21 and the merging part 15*b* of the intermediate injection passage downstream of the intermediate pressure refrigerant pipes 151 to 153. In the multistage compression system 20 of Modification 1A, only the intercooler 26 is provided in the intermediate pressure refrigerant pipe, and the merging part 15*b* of the intermediate injection passage is not provided. Modification 1A does not include the economizer heat exchanger 7. The other configurations are similar to those in the first embodiment. The oil discharge pipe 32 is connected to downstream of the intercooler 26 between the intermediate pressure refrigerant pipes as in the first embodiment.

Further, contrary to Modification 1A, the present disclosure is also effective when the multistage compression system 20 only includes the merging part 15*b* of the intermediate injection passage in the intermediate pressure refrigerant pipe and does not include the intercooler 26.

(4-2) Modification 1B

In the multistage compression system 20 according to the first embodiment, the receiver 6 and the economizer heat exchanger 7 are disposed upstream of the intermediate injection pipe. In the multistage compression system 20 of Modification 1B, only the receiver 6 is provided upstream of the intermediate injection pipe 12, and the economizer heat exchanger 7 is not provided. The other configurations are similar to those in the first embodiment.

The multistage compression system 20 of Modification 1B also has similar characteristics (3-1) to (3-4) to the multistage compression system 20 according to the first embodiment.

Further, contrary to Modification 1B, the present disclosure is also effective when the multistage compression system 20 only includes the economizer heat exchanger 7 upstream of the intermediate injection pipe 12 and does not include the receiver 6.

(4-3) Modification 1C

Figure 6:
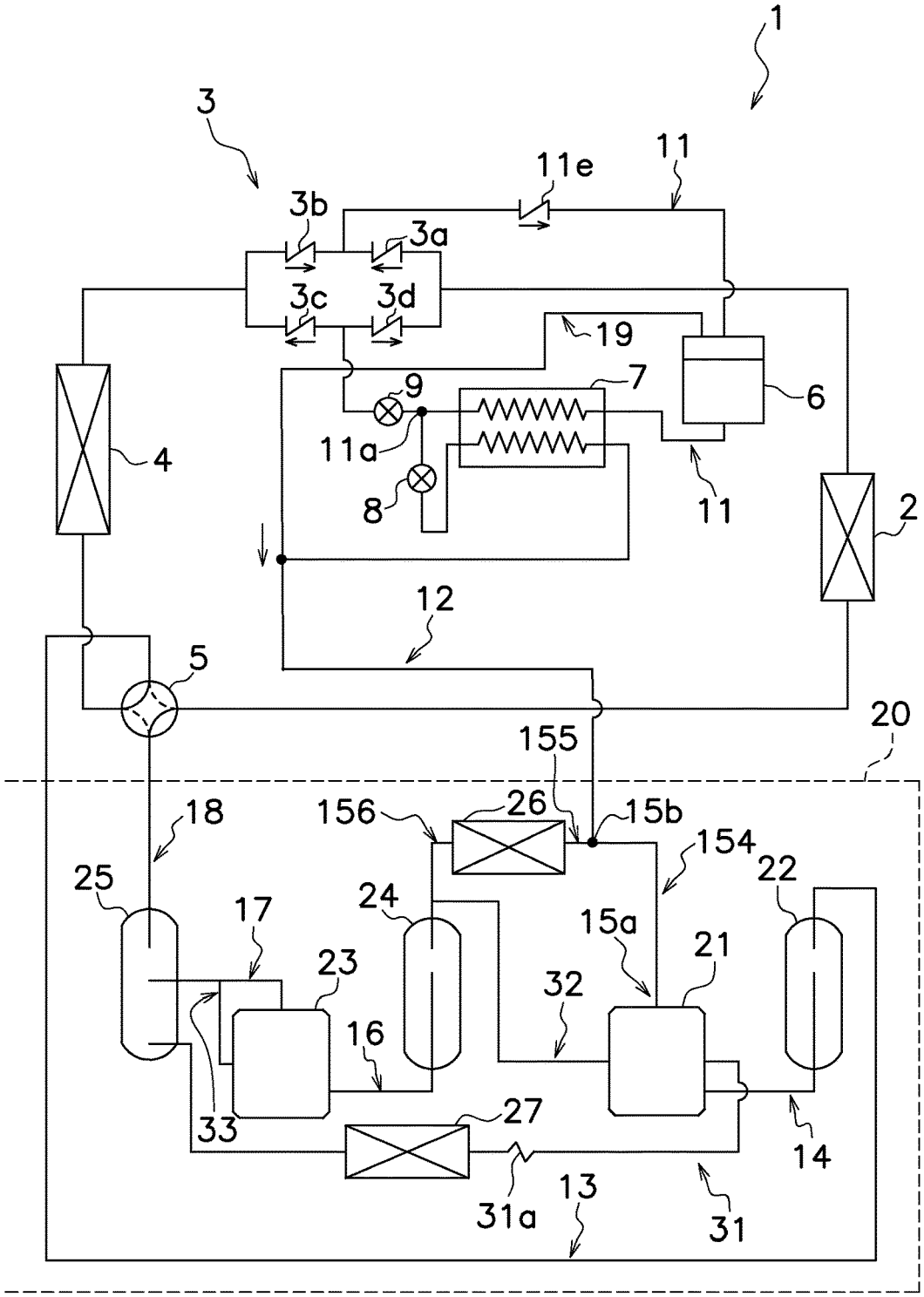
FIG. 6 is a refrigerant circuit diagram of a refrigeration apparatus 1 of Modification 1C.

The multistage compression system 20 according to the first embodiment includes the intercooler 26 upstream of the intermediate pressure refrigerant pipes 151 to 153 connected to the discharge pipe 15*a* of the low-stage compressor 21 and the merging part 15*b* of the intermediate injection passage downstream of the intermediate pressure refrigerant pipes 151 to 153. As shown in FIG. 6, the multistage compression system 20 of Modification 1E includes the merging part 15*b* of the intermediate injection passage upstream of the intermediate pressure refrigerant pipes 154 to 156 and the intercooler 26 downstream of the intermediate pressure refrigerant pipes 154 to 156. The oil discharge pipe 32 is connected to downstream of the merging part 15*b* of the intermediate injection passage on the intermediate pressure refrigerant pipe 156. The other configurations are the same as those in the first embodiment.

The multistage compression system 20 of Modification 1C also has similar characteristics (3-1) to (3-4) to the multistage compression system 20 according to the first embodiment.

The foregoing description concerns the embodiments of the present disclosure. It will be understood that numerous modifications and variations may be made without departing from the gist and scope of the present disclosure in the appended claims.

What is claimed is:

1. A multistage compression system using refrigerant and oil, the multistage compression system comprising: a low-stage compressor configured to compress and discharge the refrigerant; a high-stage compressor configured to further compress the refrigerant compressed by the low-stage compressor; refrigerant pipes configured to introduce the refrigerant compressed and discharged by the low-stage compressor into a suction part of the high-stage compressor; a pressure reducing element disposed between the refrigerant pipes; an accumulator disposed between the refrigerant pipes at a downstream side of the pressure reducing element and at an upstream side of the high-stage compressor; and an oil discharge pipe configured to discharge oil in the low-stage compressor, the oil discharge pipe connecting the low-stage compressor and a portion of the refrigerant pipes, and the portion of the refrigerant pipes being on a downstream side of the pressure reducing element and an upstream side of the accumulator.

2. The multistage compression system according to claim 1, wherein the low-stage compressor includes a compression part configured to compress the refrigerant, the compression part being a rotary compression part, a motor configured to drive the compression part, the motor being disposed above the compression part, and a container housing the compression part and the motor, and the oil discharge pipe being connected to the container below the motor and above the compression part.

3. The multistage compression system according to claim 2, wherein the pressure reducing element is an intercooler configured to cool the refrigerant discharged by the low-stage compressor before the refrigerant is sucked into the high-stage compressor.

4. The multistage compression system according to claim 2, wherein the pressure reducing element is a merging part where an intermediate injection passage merges with a portion of the refrigerant pipes, the intermediate injection passage injecting the refrigerant into the refrigerant pipes at an intermediate pressure.

5. The multistage compression system according to claim 2, wherein the pressure reducing element comprises an intercooler and a merging part, the intercooler being configured to cool the refrigerant discharged by the low-stage compressor before the refrigerant is sucked into the high-stage compressor, the merging part being a part where an intermediate injection passage merges with a portion of the refrigerant pipes, and the intermediate injection passage being a passage that injects the refrigerant into the refrigerant pipes at an intermediate pressure.

6. The multistage compression system according to claim 2, wherein the refrigerant includes carbon dioxide as a main component, and the oil is insoluble in carbon dioxide.

7. The multistage compression system according to claim 1, wherein the pressure reducing element is an intercooler configured to cool the refrigerant discharged by the low-stage compressor before the refrigerant is sucked into the high-stage compressor.

8. The multistage compression system according to claim 7, wherein the refrigerant includes carbon dioxide as a main component, and the oil is insoluble in carbon dioxide.

9. The multistage compression system according to claim 1, wherein the pressure reducing element is a merging part where an intermediate injection passage merges with a portion of the refrigerant pipes, the intermediate injection passage injecting the refrigerant into the refrigerant pipes at an intermediate pressure.

10. The multistage compression system according to claim 9, wherein the refrigerant includes carbon dioxide as a main component, and the oil is insoluble in carbon dioxide.

11. The multistage compression system according to claim 1, wherein the pressure reducing element comprises an intercooler and a merging part, the intercooler being configured to cool the refrigerant discharged by the low-stage compressor before the refrigerant is sucked into the high-stage compressor, the merging part being a part where an intermediate injection passage merges with a portion of the refrigerant pipes, and the intermediate injection passage being a passage that injects the refrigerant into the refrigerant pipes at an intermediate pressure.

12. The multistage compression system according to claim 11, wherein the refrigerant includes carbon dioxide as a main component, and the oil is insoluble in carbon dioxide.

13. The multistage compression system according to claim 1, wherein the refrigerant includes carbon dioxide as a main component, and the oil is insoluble in carbon dioxide.

* * * * *